United States Patent [19]

Hilfiker

[11] 4,117,686

[45] Oct. 3, 1978

[54] FABRIC STRUCTURES FOR EARTH RETAINING WALLS

[75] Inventor: William K. Hilfiker, Eureka, Calif.

[73] Assignee: Hilfiker Pipe Co., Eureka, Calif.

[21] Appl. No.: 852,190

[22] Filed: Nov. 16, 1977

Related U.S. Application Data

[63] Continuation-in-part of Ser. No. 724,267, Sep. 17, 1976, abandoned.

[51] Int. Cl.[2] ..... E02D 5/00

[52] U.S. Cl. ..... 405/284; 405/30

[58] Field of Search ..... 61/35, 39, 3, 4, 2, 61/37, 38, 47

[56] References Cited

U.S. PATENT DOCUMENTS 2,193,425 3/1940 Lake ..... 61/35 X

FOREIGN PATENT DOCUMENTS 206,822 12/1959 Austria ..... 61/4

814,666 3/1937 France ..... 61/37

674,209 10/1929 France ..... 61/35

105,732 4/1917 United Kingdom ..... 61/39

*Primary Examiner*—Jacob Shapiro

*Attorney, Agent, or Firm*—Naylor, Neal & Uilkema

[57] ABSTRACT

Low-cost and very effective retaining walls are constructed with stacked, generally rectangular, trays of steel wire fabric sheets, each with one end bent up to form a portion of the wall face. In constructing a wall, a first course of trays is set in place and filled, with filtering rocks and/or mats being placed toward the front and against the bent-up face section and fill soil being placed to the rear of the tray. A second course of trays is then placed on top of the first course and the corner of the face bend of the second course is securely fastened to the top of the lower course. Thus, the top of each face is supported and each course is anchored by the next course, thereby resulting in a strong monolithic and permeable wall that will readily conform to irregularities and settling of the foundation surface.

12 Claims, 9 Drawing Figures

FABRIC STRUCTURES FOR EARTH RETAINING WALLS

RELATED APPLICATION

This application is a continuation-in-part of my copending application Ser. No. 724,267, filed Sept. 17, 1976 and now abandoned.

BACKGROUND OF THE INVENTION

There are many requirements for retaining wall structures, e.g., for the prevention of soil loss by erosion or to prevent an embankment for sliding into a roadway. In many cases, conditions will require that the retaining wall be a large reinforced concrete structure and, in some instances, a single timber or concrete curb will suffice. Very often, the slope of the embankment is such that it will not require a retaining wall, and erosion can be prevented by covering the soil surface with a native stone rip-rap.

There are very many instances when it is desirable to construct a retaining wall where conditions do not justify the expense of a reinforced concrete structure. For example, it may be desired to provide a wall to prevent erosion of a creek, river or shoreline embankment. Similarly, retaining walls may be desired for preventing small earthslides onto roadways or small railroad cuts, and inexpensive, and effective, retaining walls are often desirable for industrial or residential landscaping.

One way of providing inexpensive retaining walls has been through the use of "gabions." Gabions are basket-like structures which can be filled with rock to provide permeable retaining walls. Early gabions were woven from plant fiber and not very durable. More recent gabions are fabricated of wire mesh. These recent wire mesh gabions are probably the most significant prior art to the present invention.

SUMMARY OF THE INVENTION

The present invention is for a generally rectangular steel wire fabric tray and for the method of using a plurality of these trays to construct an inexpensive retaining wall that is a strong monolithic anchored structure that is flexible and conforms to possible settling of the soil and is also water-pervious, requiring no drainage or weepholes such as are necessary in masonry or other solid structures.

Briefly described, the tray of the invention is comprised of a rectangular sheet of welded steel wire fabric with one end bent up to form a portion of the retaining wall face. A first course of trays is set in place and filled, with the larger rocks and/or mats being placed toward the face or bent-up end, and soil placed to the rear of the rocks or mats. A second course is then placed on top of the first course and the corner bend of the second course is then secured to the top of the face of the lower course. The second course is then filled and additional courses as required are applied, the bend of each being secured to the top of the face of the preceding course to provide rigidity to the course faces and a thoroughly anchored structure.

Brief Description of the Drawings

In the drawings that illustrate preferred embodiments of the invention.

DESCRIPTION OF THE ILLUSTRATED EMBODIMENTS

Figure 1:
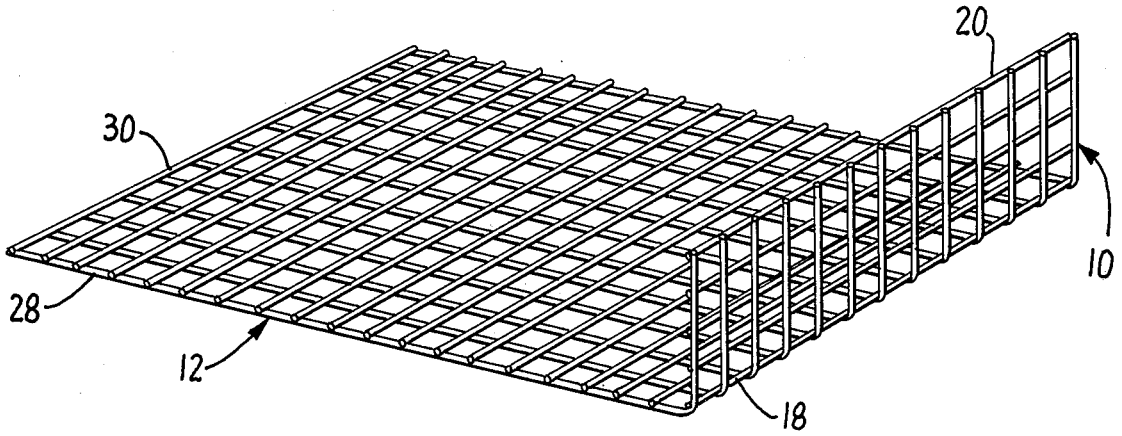
FIG. 1 is a perspective view of a first embodiment of a steel wire fabric tray of the invention.

Illustrated in FIG. 1 is a tray comprised of a sheet of welded steel wire fabric which is folded to provide a face 10 that is substantially at right angles to the floor 12. While any suitable dimensions may be acceptable, the tray of the embodiment illustrated in FIG. 1 is, for example, formed of a rectangular sheet of 2-inch by 2-inch steel wire fabric that is 4-to-8 feet wide and of a length sufficient to provide stability. The face 10 is typically approximately sixteen inches high. Preferably, the trays have a floor length equal to approximately eighty percent of the composite height of a wall fabricated from the trays. In the preferred embodiment, the fabric is welded wire reinforcing mesh that is galvanized for durability.

Figure 2:
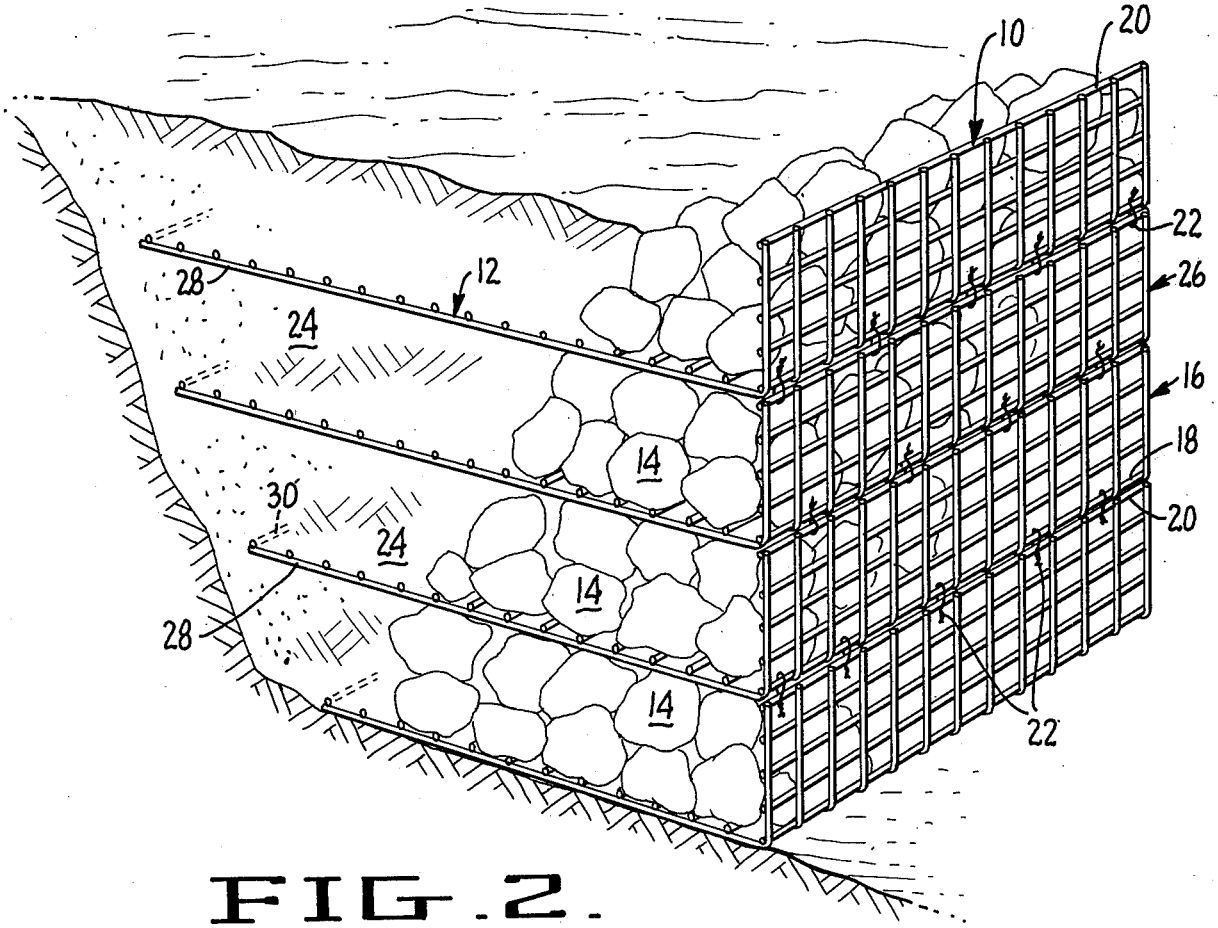
FIG. 2 is a cross-sectional elevation view of a retaining wall using four courses of trays of the type illustrated in FIG. 1.

As previously indicated, a retaining wall is formed by stacking a plurality of courses of the trays of FIG. 1. As illustrated in FIG. 2, the floor 12 of the tray is placed on the soil surface and at least the portion of the tray that is adjacent to the face 10 is filled with rock substantially larger than the spacing between the wire mesh. In the embodiment illustrated in FIG. 2, the tray is formed of 2-inch by 2-inch mesh and the rock 14 behind the face 10 is preferably a four-inch rock. Smaller rock may be accommodated adjacent to the face by lining the face with a plastic filter liner having openings therein of sufficiently small size to prevent the rock from passing therethrough.

A second course 16 of trays is stacked upon the first course so that the face of the second course is substantially coplanar with the face 10 of the first course, and the fold 18 of the second course 16 is secured to the top 20 of the lower course by suitable fasteners 22. Although the fasteners 22 are illustrated as being wire wrappings, they may assume other forms, such as relatively rigid hooks fixed to one tray and hooked over a portion of the tray mated therewith. The trays of the second course 16 are then partially filled with four-inch rock 14 and suitably backfilled with soil 24, as required.

A third course 26 of trays, and additional courses as necessary, may then be added and rock-filled after securing the bottom of the face of each course to the top of the face of the next lower course. By thus securing the faces to each other, it is apparent that the longitudinal wires 28 in the tray floors become very effective anchor rods that interconnect the top and bottom of each of the course faces to the transverse wires 30 that interconnect each of the longitudinal wires 28 and which are securely buried in the backfill material 24. Thus, all of the transverse wires 30 in each floor 12 are interlocked in the backfill material 24 and serve as an effective deadman that is connected by the plurality of longitudinal anchor wires 28 to the top and bottom of the face 10 of each tray, thereby securing each tray from longitudinal movement and deformation of the face that may be caused by the heavy rock 14.

It is apparent that the final or top course will not have support for the top of its face which may, therefore, be deformed by the large rock 14. If this possibility is not desirable, the top of the face of the top course may be supported by connecting anchor wires between the top rung of the face and a transverse wire 30 near the center of the floor 12. Alternatively, the top course may be topped with another row of trays that are inverted so that their faces may be wired to the tops and bottoms of the faces of the top course and their floors lie atop the rock fill of the top course. Additional fill will then assure that the face of the top course will not be deformed because of nonsupport.

Figure 3:
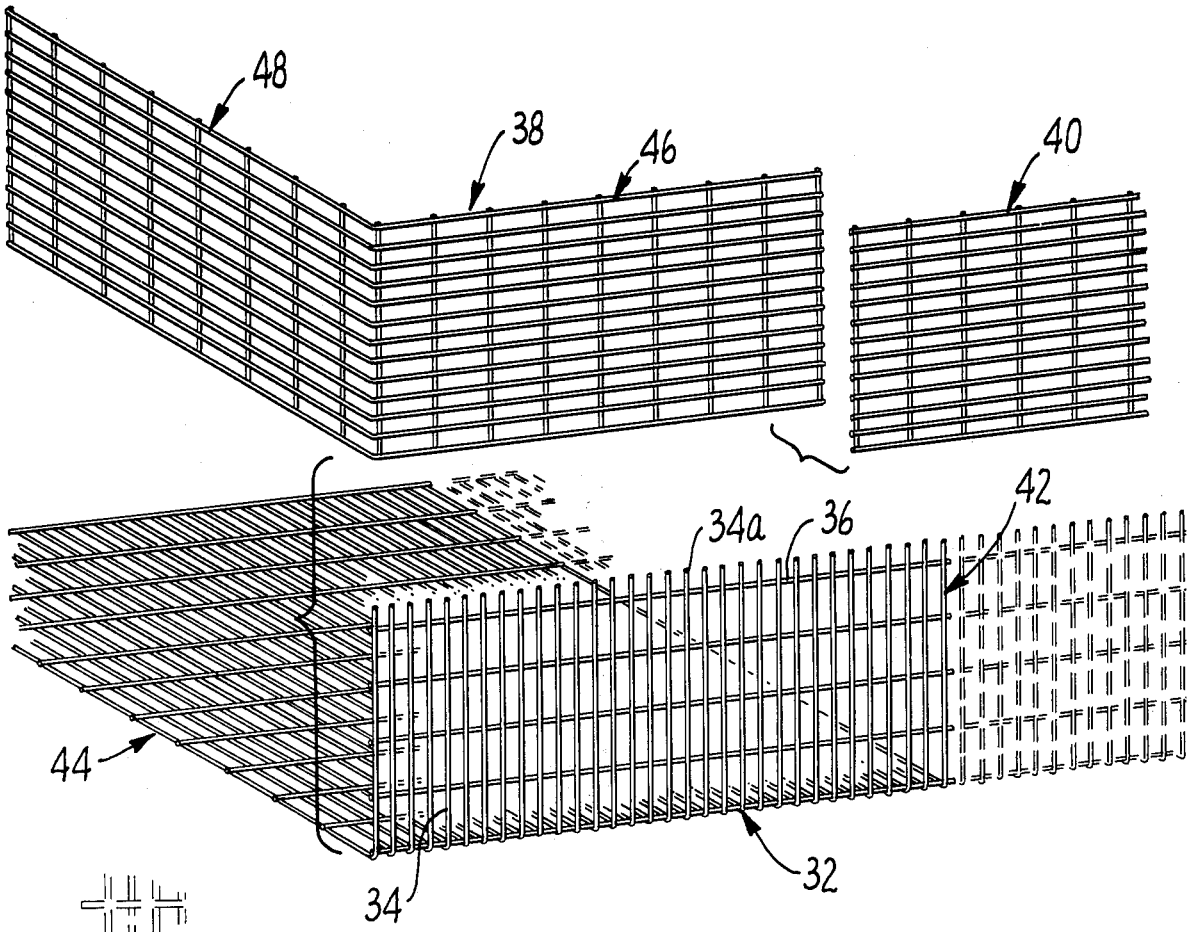
FIG. 3 is an exploded perspective view of a pair of steel wire trays constructed according to a second embodiment of the invention, employed in combination with wire matting disposed behind the face sections of the trays.
Figure 7:
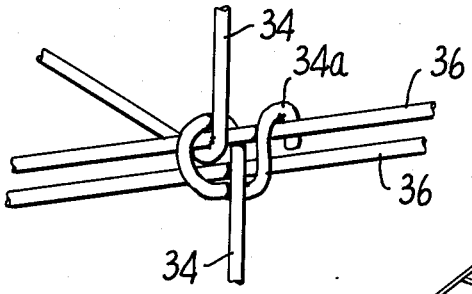
FIG. 7 is a perspective view of the tie used between superimposed trays of the type illustrated in FIGS. 3, 4, 5 and 6.

The tray illustrated in FIG. 3 is designated in its entirety by the numeral 32. This tray is of generally the same dimensions and construction as the aforedescribed tray of FIGS. 1 and 2, with the exception that it is fabricated of 2-inch by six-inch nine-gauge galvanized wire mesh. As shown, the longitudinal grids of the trays, designated 34, are spaced on two-inch centers and the transverse grids of the tray, designated 36, are spaced on 6-inch centers. Another difference between the tray of FIG. 3 and that of FIGS. 1 and 2 is that the longitudinal grids 34 include extension 34a extending beyond the topmost transverse grid 36. The purpose of the extensions 34a is to provide a length of wire which may be used to tie successive trays together, as illustrated in FIG. 7. Thus, with FIG. 3-type trays, separate ties (such as the ties 22 shown in FIG. 2) are not necessary.

Figure 4:
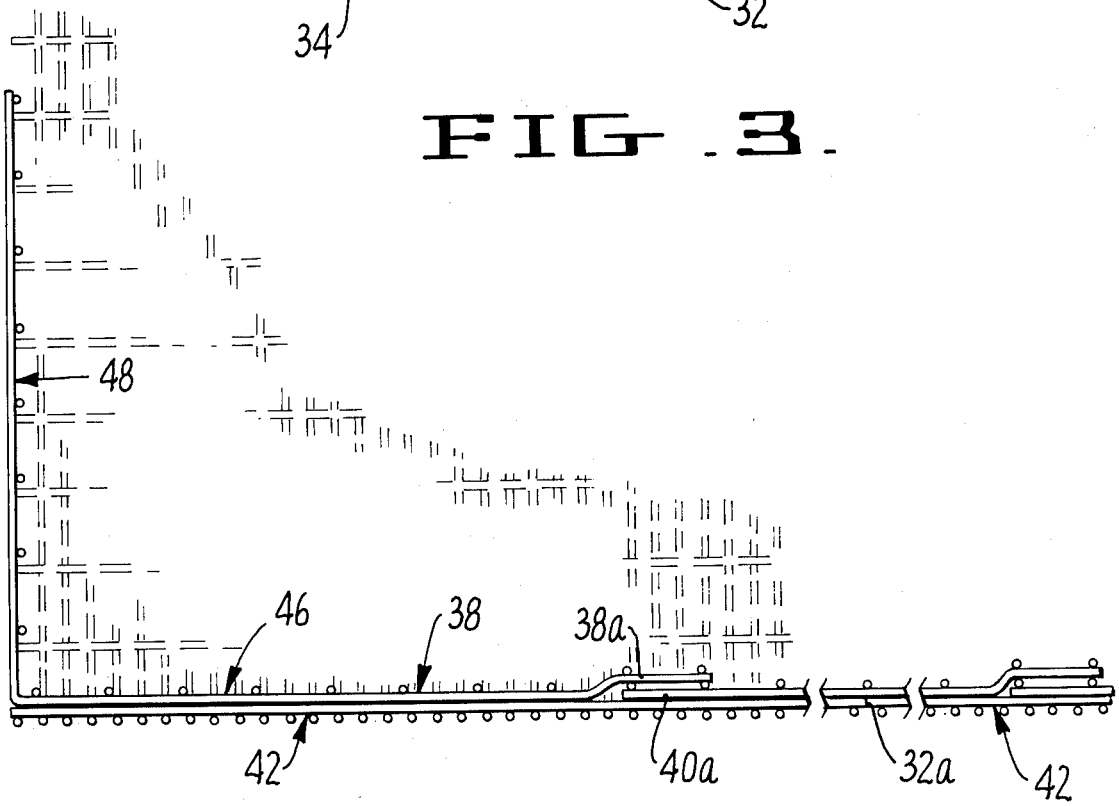
FIG. 4 is a plan view of the combined trays and mats shown in FIG. 3.

As illustrated in FIGS. 3 and 4, two trays 32 are provided, with the edges thereof abutting, and mats 38 and 40 are disposed behind the face sections of the trays. The face and floor sections of the trays 32 are designated by the numerals 42 and 44, respectively. The mats 38 and 40 are fabricated of two-inch by six-inch nine-gauge galvanized wire mesh similar to that used to fabricate the trays. The gridwork of the mats 38 and 40 is turned 90° from that of the trays in order that, when the mats are in superimposed position behind the base sections of the trays, the mats serve to reduce the size of the openings in the face sections to a 2-inch by 2-inch dimension.

The mats 38 and 40 are disposed in edge-overlapping relationship to one another. As may be seen from FIG. 4, the overlapping portion of the mat 38 is designed **38*a* and the overlapping porton of the mat 40 is designated 40*a*. The butt joint between the adjacent trays 32 shown in FIG. 4 is designated by the numeral 32*a*** and, ideally, that joint does not coincide with the overlapping joint between the mats.

FIGS. 3 and 4 show the mat 38 as being a right-angled configuration, with a base section designated 46 and a leg section designated 48. In the assembled condition, the leg section 48 is disposed to extend at right angles from one edge of the tray 32 to provide a grid back wall at that edge. The section 48 provides an end wall to the side of an open body of soil to be reinforced. Such end walls are ideally provided at side locations where the earthen formation to be reinforced is exposed. The purpose of the walls is to aid in preventing the sides of the formation from sloughing away and eroding.

Figure 5:
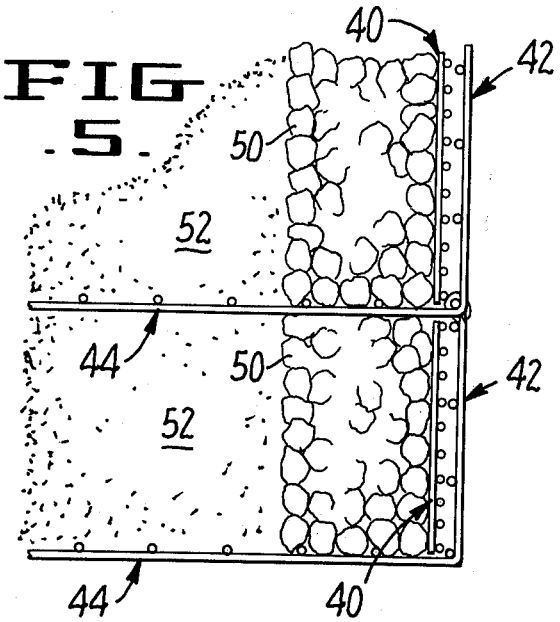
FIG. 5 is a cross-sectional elevation view of superimposed trays used in combination with mats as shown in FIGS. 3 and 4, as the trays would appear when assembled into a retaining wall.

FIG. 5 is a cross-sectional elevation view of a reinforced earthen wall constructed of superimposed structures of the type illustrated in FIGS. 3 and 4. As shown in FIG. 5, the upper edge of the lower tray is secured to the lower edge of the upper tray by connection of the type illustrated in FIG. 7. Mats 40 are shown disposed behind the face sections 42 of the trays and rocks 50 of two-inch minimum cobble are shown disposed behind the mats. Behind the rocks 50 the wall is backfilled with earthen backfill, designated 52. A reinforced earthen structure such as that shown in FIG. 5 would be assembled in generally the same manner described with reference to FIG. 2, with the addition of the placement of the mats 40 in advance of the rock 50.

Figure 6:
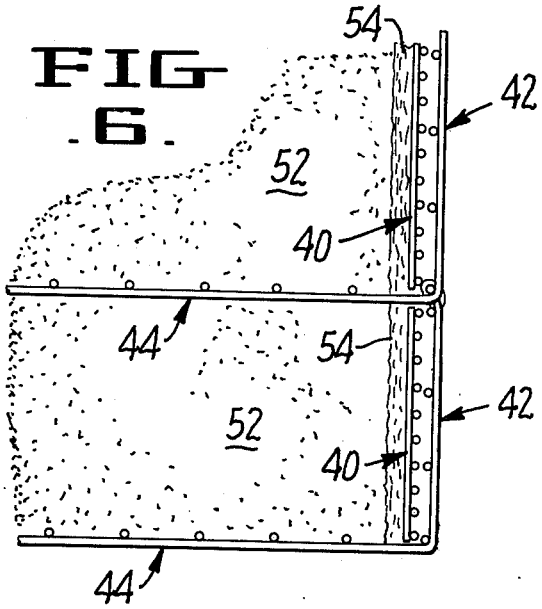
FIG. 6 is a cross-sectional elevation view of a tray of the type illustrated in FIGS. 3 and 4, employing behind the face section thereof an alternative forms of mat to that illustrated in FIGS. 3, 4 and 5.

FIG. 6 illustrates a wall corresponding to that of FIG. 5, with the exception that a water-permeable filter mat 54 is used in place of the rocks 50. The mat 54 is of conventional construction-quality filter mat material. Typically, such material is fabricated of glass fiber or plastic and has a thickness of approximately one-half inch. The use of the mat 54 alleviates the need for rock to prevent the backfill 52 from eroding away through the face sections of the trays.

Figure 8:
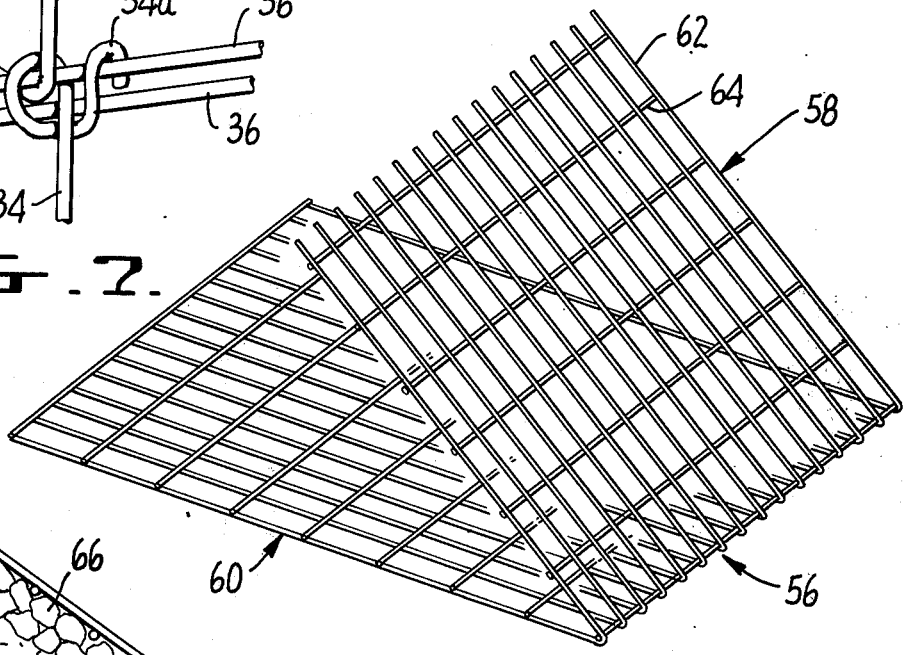
FIG. 8 is a perspective view of a third embodiment of a steel wire fabric tray of the invention.
Figure 9:
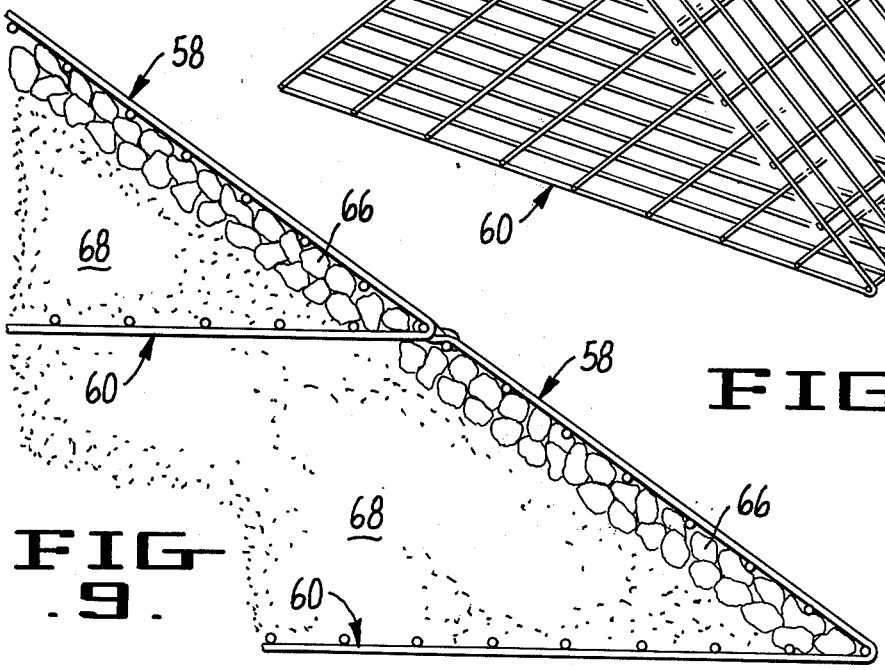
FIG. 9 is a cross-sectional elevation view of a retaining wall constructed of superimposed courses of trays of the type illustrated in FIG. 8.

The tray illustrated in FIG. 8 is fabricated of the same type of nine-gauge 2-inch by 6-inch galvanized wire mesh as that of the FIGS. 3 and 4 embodiment. The tray of FIGS. 8 and 9 is designated in its entirety by the numeral 56. It comprises a base section 58 and a leg section 60. The longitudinal grids 62 of the trays 56 are on 2-inch centers and the transverse grids 64 of the trays are on 6-inch centers. The grids 64 have extensions 64a to provide ties similar to those provided by the extensions 34a.

The aforedescribed nine-gauge two-inch by 6-inch galvanized wire mesh used for both the embodiments of FIGS. 3 and 4 and that of FIGS. 8 and 9 is of the welded type. Thus, the transverse grid elements of the trays 32 and 56 serve to securely anchor a wall fabricated of the trays. This anchoring function corresponds to that described with reference to the FIGS. 1 and 2 embodiment.

The principal difference between the trays 56 of the FIGS. 8 and 9 embodiment and trays 32 of the FIGS. 3 and 4 embodiment is that the face sections of the trays 56 extended at an acute angle relative to the floor sections of the trays, while the face sections of the trays 32 extend generally normal to the floor sections of the trays. The acute angle is provided so that the trays 56 may be employed to build a retaining wall with a sloped face, as shown in FIG. 9. When assembled into such a wall, the trays 56 are disposed in superimposed relationship to one another with the face section of each tray tied to the intersection of the floor and face sections of the tray thereabove. The wall in FIG. 9 is backfilled with rock 66 disposed adjacent to the face sections and dirt fill 68 is disposed behind the rock. The rock is of sufficient size that it will not pass through the grids of the trays. Mats similar to the mats 40 are not shown in FIG. 9. It should be understood, however, that such mats could be employed if so desired. It is also possible to employ filter mats in a manner similar to the mats 54 described with reference to FIG. 6.

Since the trays of the invention contain coarse rock and/or relatively pervious mats adjacent to the faces, it is apparent that a retaining wall formed by a plurality of courses of trays will be pervious to water and that weepholes would be unnecessary. Another feature of the invention is that the rocks and/or mats and the backfill soil 24 will support vegetation, thus providing aesthetic advantages while the vegetation roots add strength to the retaining wall structure.

Conclusion

Although preferred embodiments of the invention have been illustrated and described, it should be understood that the invention is not intended to be limited to the specifics of these embodiments, but rather is defined by the accompanying claims.

What is claimed is:

1. A retaining wall structure comprising: a generally rectangular steel wire tray defined by an elongate floor section extending over the length of the tray and a face section of a depth less than the length of the floor section extending at an angle relative to the floor section, said tray having longitudinal rods extending continuously over the length thereof and across said floor and face sections in spaced, generally parallel relationship to one another and cross-rods welded to and extending transversely across said longitudinal rods in spaced relationship to one another; and, a mat overlaying the face section to the side thereof from which the floor section extends, said mat being generally coextensive with the face section and fabricated of a water-permeable material of sufficient density to prevent the substantial erosion of soil therethrough.

2. A retaining wall structure, according to claim 1, wherein said floor and face sections intersect at a fold line and one of said cross-rods is disposed at, and extends along, said fold line.

3. A retaining wall structure comprising a generally rectangular steel wire tray defined by an elongate floor section extending over the length of the tray and a face section of a depth less than the length of the floor section extending at an angle relative to the floor section, said tray having longitudinal rods extending continuously over the length thereof and across said floor and face sections in spaced, generally parallel relationship to one another and cross-rods welded to and extending transversely across said longitudinal rods in spaced relationship to one another; and, a mat to the side of the tray from which the floor section extends, said mat being of a wire grid construction and having a first portion generally coextensive with and overlaying the face section of the tray and a second portion extending at an angle from an edge of the face section.

4. A retaining wall structure comprising a plurality of generally rectangular steel wire trays, each of said trays being defined by an elongate floor section extending over the length of the tray and a face section of a depth less than the length of the floor section extending at an angle relative to the floor section, said respective trays being disposed in superimposed relationship to one another with the floor sections thereof generally parallel to one another and the face sections of successive trays secured together so that the intersection between the floor and face sections of one tray is secured to the distal edge of the face section of the next adjacent tray, said trays each having longitudinal rods extending continuously over the length thereof and across the floor and face sections in spaced, generally parallel relationship to one another and cross-rods welded to and extending transversely across said longitudinal rods in spaced relationship to one another.

5. A retaining wall structure, according to claim 4, wherein the floor and face sections of each tray intersect at a fold line with one of the cross-rods of the tray extending along the fold line.

6. A retaining wall structure, according to claim 4, wherein the length of floor sections of the trays, as measured from the intersection of the face and floor sections, is equal to approximately eighty percent of the composite height of the superimposed trays.

7. A retaining wall structure, according to claim 4, further comprising mats overlaying the face sections of the trays to the sides of the face sections from which the floor sections extend, said mats being generally coextensive with the face sections and fabricated of a water-permeable material of sufficient density to prevent the substantial erosion of soil therethrough.

8. A retaining wall structure according to claim 4, further comprising mats to the side of the trays from which the floor sections extend, at least some of said mats having a first portion generally coextensive with and overlaying the face section of a tray and a second portion extending at an angle from the edge of the face section of said tray.

9. A retaining wall structure according to claim 4 wherein the face sections of the respective trays are secured together by extended portions formed on the distal ends of the longitudinal rods in the face sections of the trays.

10. A method of constructing a retaining wall, said method comprising:

providing a plurality of generally rectangular steel wire trays, each of said trays being defined by an elongate floor section extending over the length of the tray and a face section of a depth less than the length of the floor section extending at an angle relative to the floor section, said trays each having longitudinal rods extending continuously over the length thereof and across the floor and face sections in spaced, generally parallel relationship to one another and cross-rods welded to and extending transversely across said longitudinal rods in spaced relationship to one another;

successively superimposing said trays upon one another with the floor sections thereof generally parallel to one another and the face sections of successive trays secured together so that the intersection between the floor and face sections of one tray is secured to the distal edge of the face section of the next adjacent tray;

placing a mat over the face section of each tray to the side thereof from which the floor section extends prior to the placement of the next successive tray, said mat being generally coextensive with the face section and fabricated of a waterpermeable material of sufficient density to prevent the substantial erosion of soil therethrough; and filling each tray with soil after the placement of the mat over the face section of the tray and prior to the placement of the next successive tray.

11. A method of constructing a retaining wall, said method comprising:

providing a plurality of generally rectangular steel wire trays, each of said trays being defined by an elongate floor section extending over the length of the tray and a face section of a depth less than the length of the floor section extending at an angle relative to the floor section, said trays each having longitudinal rods extending continuously over the length thereof and across the floor and face sections in spaced, generally parallel relationship to one another and cross-rods welded to and extending transversely across said longitudinal rods in spaced relationship to one another;

successively superimposing said trays upon one another with the floor sections thereof generally parallel to one another and the face sections of successive trays secured together so that the intersection between the floor and face sections of one tray is secured to the distal edge of the face section of the next adjacent tray; and, filling each tray with earth and stone material prior to the placement of the next successive tray so that the material adjacent to the face of the tray is stone of a size greater than the spacing between adjacent rods of the tray.

12. A method, according to claim 11, wherein the length of the floor section of the trays, as measured from the intersection of the face and floor sections, is chosen to equal approximately eighty percent of the composite height of the superimposed trays.

* * * * *